United States Patent [19]

Priest

[11] Patent Number: 4,830,223

[45] Date of Patent: May 16, 1989

[54] DRINKING WATER SENDING AND DISPENSING SYSTEM

[76] Inventor: D-Eon Priest, P.O. Box 3531, 1600 E. 4th St., Big Spring, Tex. 79720

[21] Appl. No.: 176,450

[22] Filed: Apr. 1, 1988

[51] Int. Cl.[4] ..... B67D 5/06

[52] U.S. Cl. ..... 222/146.6; 222/183; 222/189; 62/390

[58] Field of Search ..... 222/146.6, 183, 189, 222/331, 383; 141/98, 285; 62/389, 390, 396, 399

[56] References Cited

U.S. PATENT DOCUMENTS

| | | | |
|---|---|---|---|
| 3,333,438 | 8/1967 | Benua et al. | 62/395 |
| 3,333,741 | 8/1967 | Radcliffe | 222/189 |
| 3,429,140 | 2/1969 | White | 62/390 |
| 3,495,612 | 2/1970 | Moreland et al. | 137/209 |
| 3,584,472 | 6/1971 | Sholtes | 62/394 |
| 3,882,693 | 5/1975 | Hiller | 62/394 |
| 4,081,621 | 3/1978 | Hartley | 200/83 |
| 4,214,137 | 7/1980 | Hartley | 200/83 |
| 4,242,061 | 12/1980 | Hartley | 417/536 |
| 4,610,605 | 9/1986 | Hartley | 417/269 |
| 4,655,123 | 4/1987 | Schrader | 222/383 |

*Primary Examiner*—Andres Kashnikow
*Assistant Examiner*—Karen B. Merritt

[57] ABSTRACT

A water sending and dispensing system includes a cabinet (10) in which a water container (12) is disposed. The water container (12) has a fluid-impermeable wall (14) and a filtered opening (18). A draw tube (32) and a refill tube (20) are sealably inserted through the filtered opening (18). The upper end (24) of the refill tube (20) is attached to a refill chamber (28) that allows the easy refill of the container (12). An upper end (36) of the suction tube (32) is connected to an inlet (38) of a pump (40), which is preferably of the self-priming, pressure demand, diaphragm type. An outlet (42) of the pump delivers water to the exterior. This water is preferably delivered at an elevated pressure, allowing the use of a water supply of superior quality in conventional appliances remote from the cabinet (10).

18 Claims, 1 Drawing Sheet

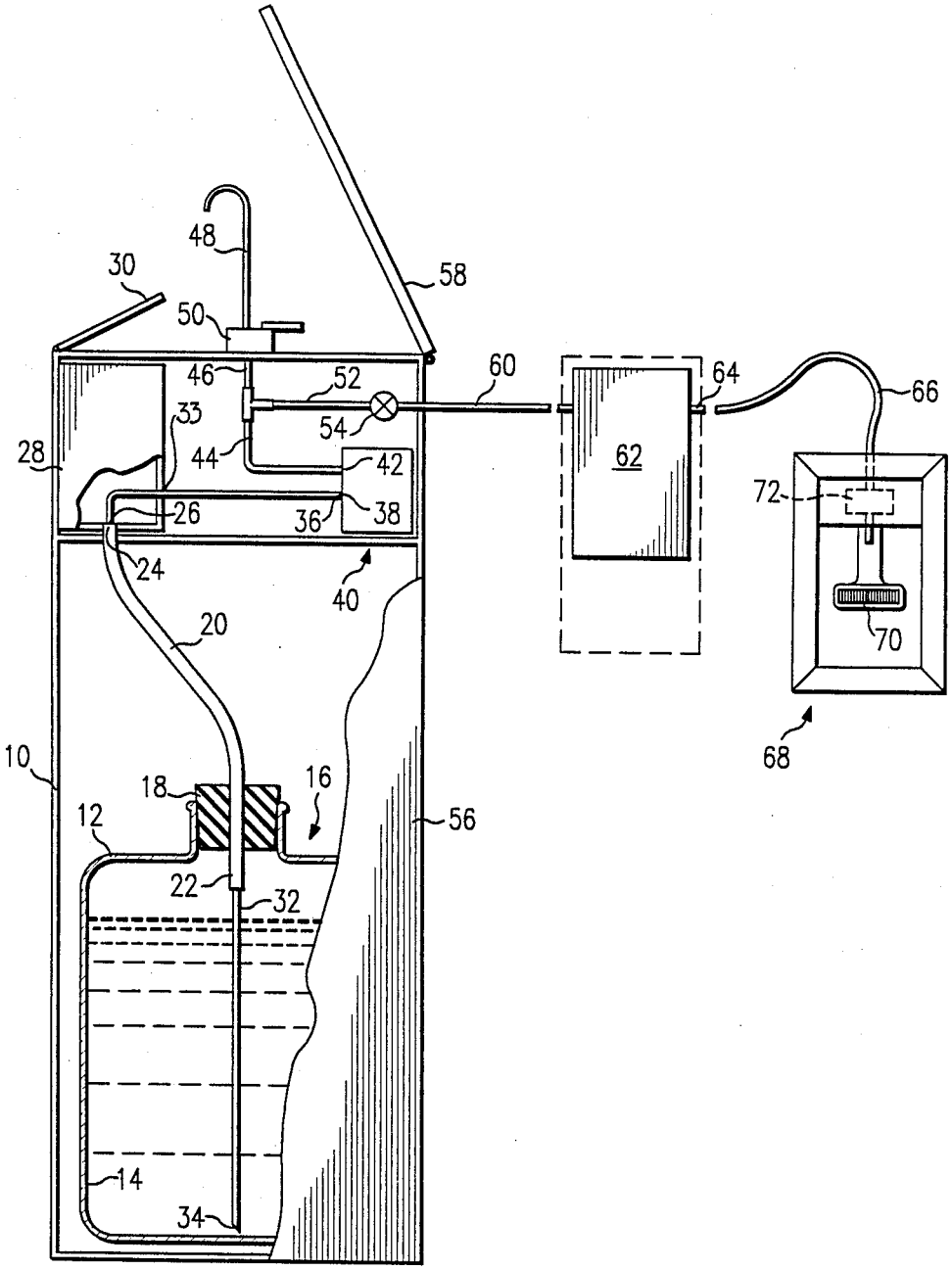
48
30
58
50
46
52
60
64
66
33
54
28
44
42
62
72
26
36
38
24
40
20
70
68
10
18
16
12
56
22
32
14
34

DRINKING WATER SENDING AND DISPENSING SYSTEM

TECHNICAL FIELD OF THE INVENTION

This invention relates in general to water dispensing systems, and more particularly to a filtered vent air water dispensing system that dispenses drinking water at elevated pressures.

BACKGROUND OF THE INVENTION

Conventional stand-alone drinking water dispensing systems usually are built around an inverted water bottle that relies on gravity to dispense the drinking water. The inverted water bottles of these systems are in general clumsy, unsanitary, hard to lift, and constructed of heavy glass or plastic.

The use of gravity flow in dispensing the drinking water requires lifting the water above the outlet. The water pressure thus generated is generally too weak to send to appliances remote from the stand-alone unit. Because of this, most water dispensers build in costly refrigeration and/or heating units. Examples of gravity-flow water dispensing systems are illustrated in U.S. Pat. No. 3,333,438 issued to Benua et al.; U.S. Pat. No. 3,495,612 issued to Moreland II, et al.; and U.S. Pat. No. 3,584,472 issued to Sholtes. These patents are incorporated by reference to show conventional details of stand-alone water dispensing system construction. The incorporation of refrigeration and heating units in conventional stand-alone dispensing systems is a costly duplication where the owner has another refrigeration or heating unit, such as a refrigerator or stove. However, the low, gravity-generated pressure system used in most conventional systems prohibits transmitting water to these other appliances.

Certain conventional units use a pump that pressurizes the air inside of the water bottle. The disadvantages inherent in these systems include the requirement of a strong, sealable bottle which is of a single predetermined size and shape. The pumping air or the vent air used in conventional systems is not filtered, allowing the introduction of particulate matter into the water. Further, conventional stand-alone units have no easy means for refill of the container, necessitating the removal and replacement of the container.

Therefore, a need exists for a stand-alone water dispensing unit that dispenses water at sufficient pressures for transmission to other appliances, that can be easily refilled, that can accommodate different kinds of bottles, and that does not permit the introduction of particulate matter through non-filtered venting air.

SUMMARY OF THE INVENTION

One aspect of the invention comprises a water dispensing system having a cabinet for receiving a water container therein. A filter is fitted over the opening of a container, which can be of any type as long as it has otherwise an impermeable wall. The filtered opening permits the passage of air into the container, but excludes airborne contaminants.

The dispensing system further includes a draw tube and a refill tube. First ends of the draw tube and the refill tube are sealably introduced into the interior of the water container, while second ends of the tubes are disposed to the exterior thereof. A sealable refiller or refill chamber is disposed in the cabinet for receiving water and is coupled to the second end of the refill tube for refilling water into the water container. The system further includes a water pump disposed in the cabinet that has a first inlet coupled to the second end of the draw tube and an outlet. A water delivery tube is coupled to the outlet for delivering water pumped from the container.

In another aspect of the invention, the water dispensing system incorporates a pump that delivers pressurized water to other appliances at a pressure much elevated above that obtained from gravity alone. The pump is preferably of the demand type, such that when the pump experiences a drop in the pressure, it will be turned on unitl a preselected pressure at the outlet is regained.

According to another aspect of the invention, the pump transmits pressurized water to a pressurized chilling chamber that is placed inside a conventional refrigerator or the like. A dispensing tube is connected to the outlet of the chilling chamber and is connected to a water dispenser. In this way, a conventional refrigeration system can be used to chill high-quality drinking water without unnecessary duplication of refrigerating apparatus.

BRIEF DESCRIPTION OF THE DRAWINGS

Other aspects of the invention and their advantages are set forth in the following detailed description of a preferred embodiment of the invention. This preferred embodiment is illustrated by the appended drawings, in which:

The FIGURE is a front elevational, schematic cross-sectional view of a drinking water sending and dispensing system according to the invention.

DETAILED DESCRIPTION OF THE INVENTION

Referring to the FIGURE, a part schematic, part cross-sectional view of a drinking water dispensing and sending system according to the invention is shown. Most of the components of the system are preferably incorporated within a housing 10 that can be conventionally fabricated of sheet metal or the like. A conventional water container 12, which can be of any type, is preferably disposed in a lower section of housing 10. For operation with the invention, water container 12 should have a liquid- and gas-impermeable wall 14 that defines the interior of the container. Wall 14 should further enclose the interior of the container except for an opening indicated generally at 16 that is sealably closed by a filter cap 18. Filter cap 18 includes a one micrometer filter that sealably extends over the opening. A flexible refill tube 20 is sealably inserted into a respective orifice (not shown) in filter cap 18 such that a first end 22 thereof is in the inside of the container.

An upper end 24 of refill tube 20 is connected to an outlet 26 of a refill chamber 28 that is disposed above water container 12, and is preferably located at the top of cabinet 10. Refill chamber 28 is normally sealed closed by a cap 30.

A suction tube 32 is routed through end 22 into the interior of tube 20, out of end 24, and sealably through a hole 33 in chamber 28. The routing of tube 32 through the interior of tube 20 is advantageous in that only one hole need be provided in filter cap 18.

A lower end 34 of tube 32 is disposed near the bottom of container 12. An upper end 36 of tube 32 is sealably affixed to an inlet 38 of an electrical pump schematically illustrated generally at 40. The inner diameter of tube 20 should be substantially larger than the outer diameter of tube 32. Pump 40 is preferably of the self-priming, pressure-demand type that is switched on when a drop in the pressure is sensed by a sensor (not shown) incorporated into its pump housing (not shown). Pump 40 should be capable of pumping water through its outlet 42 at a pressure of at least 30 lbs/sq.in., and should be relatively quiet in its operation. Therefore, although a piston-type water pump could be used, it is preferred that the pump be of a type that is more quiet in its operation, such as a diaphragm type. A particularly preferred pump is manufactured by Shur-Flo of Anaheim, California, and draws ½ to 2 amperes of current at 110/120 volts.

A delivery tube 44 is sealably affixed to outlet 42, and should be constructed of a material capable of withstanding the output pressure of pump 40. Delivery tube 44 preferably has a branch 46 that is connected to a room-temperature water spigot 48 that has a hand valve 50. Another branch 52 of delivery tube 44 is connected through an appliance cut-off valve 54 to deliver pressurized water to appliances remote from cabinet 10.

Cabinet 10 further preferably includes a door 56 to which access to the interior can be made. It may, for example, be desirable to change out water bottle 12 from time to time notwithstanding that it is refillable. Cabinet 10 may further include a working surface 58 that is hinged as a countertop to the top of cabinet 10. This working surface preferably takes up approximately 80% of the top surface of cabinet 10. A remaining 20% is fixed in place and includes spigot 48. Spigot 48 swivels to avoid occluding the travel of hinged counter top 58.

An outside delivery tube 60 delivers purified, pressurized water to one or more selected appliances remote from cabinet 10. For example, outside delivery tube 60 can deliver water to a humidifier, a heating unit, an ice maker or the like. In the illustrated embodiment, outside delivery tube 60 delivers pressurized water to a pressurized chilling chamber 62. Chilling chamber 62 can be of the type presently manufactured for installation in refrigerators having water glass fillers in their doors. In this instance, outside delivery line 60 is fed through an appropriate sealed orifice in the wall of a conventional refrigerator, and chilling chamber 62 is placed inside the refrigeration compartment. Chilling chamber 62 is manufactured out of a plastic sufficiently tough to withstand at least 50 to 100 psi of pressure. Chilling chamber 62 has an outlet 64 that is connected through a further pressurized line 66 to a remote chilled water dispenser indicated generally at 68. Dispenser 68 in the illustrated embodiment has a pressure plate 70 that actuates a valve 72 when a glass or the like is pressed against plate 70. Remote water dispenser 68 may, for example, be mounted to the exterior of a conventional refrigerator.

In operation, water container 12 is refilled through refill chamber 28 and refill tube 20. The provision of sealable cap 30 prevents the introduction of particulate matter into the drinking water. As the water in chamber 12 is either refilled or drawn down, vent air passes through filter cap 18, which however prevents particulate matter from contaminating the water supply. The provision of refill chamber 28 allows the ability to easily refill water container 12, which therefore does not have to be readily removable. Further, since water inside water container 12 is at ambient pressure, a rigid, thick-wall container is not required. Container 12 can therefore be fabricated of lighter or less expensive materials and can be configured to closely conform to the exterior walls of cabinet 10, thereby providing the maximum water volume in the least space. For example, the usual 5-gallon cylindrical polycarbonate container can be replaced with a 5-gallon square polyethylene bottle at one-third the cost.

In response to a lowering of pressure at its pump housing (not shown), pump 40 will be turned on, drawing water from chamber 12 up suction tube 32 into the pump housing. Pump 40 will then pump pressurized water through delivery tube 44 and branches 46 and 52. This pumping action will continue until a predetermined pressure at outlet 42 is regained.

Pressurized water can be supplied to chilling chamber 62 as previously described, which is preferably situated in the interior of a conventional refrigerator. The separate chilling chamber 62 allows for the chilling of purified water inside a conventional refrigeration unit without costly duplication of refrigeration equipment inside stand-alone unit 10. Pressurized water can be delivered to a glass or the like through remote dispenser 68 if chilled water is desired, or, alternatively, at room temperature through spigot 48.

In alternative embodiments, exterior delivery tube 60 can be connected to a wet bar spigot or the like. Water container 12 can be of almost any size, shape or material, so long as it is water- and gas-impermeable.

The present invention allows the provision of a superior or purified water supply from, for example, trucked-in water and supplies this purified water at an elevated pressure on an external line. Because of the elevated pressure, the stand-alone water system does not have to duplicate refrigeration, heating or other equipment, but can be connected to conventional appliances that already perform these functions. The present invention prevents the introduction of particulate matter into the purified water supply by filtering the vented air, and allows the container thereof to be easily refillable through a refill chamber built into the cabinet.

While a preferred embodiment of the invention has been described in the above detailed description, the invention is not limited thereto, but only by the spirit and scope of the appended claims.

What is claimed is:

1. A water dispensing system, comprising:

a cabinet for receiving a water container therein, said container of the type having at least one liquid-impermeable wall and an opening in said wall, a filter across said opening for permitting the passage of air into said container but excluding airborne contaminants;

a draw tube and a refill tube, first ends of said draw tube and said refill tube sealably introduced into the interior of said water container, second ends of said tubes disposed to the exterior of said container;

a sealable refiller disposed in said cabinet for receiving water thereinto and coupled to said second end of said refill tube for refilling water into said water container;

a water pump disposed in said cabinet and having an inlet coupled to said second end of said draw tube and an outlet; and a water delivery tube having an end coupled to said water pump outlet for delivering water pumped from said container at an elevated pressure.

2. The system of claim 1, wherein said refiller comprises a refill chamber disposed above said water container, said refill chamber having an unsealable and resealable opening for introducing water thereinto.

3. The system of claim 1, and further comprising a door on said cabinet for permitting access to the interior thereof, said water container removable from said cabinet.

4. The system of claim 1, wherein said filtered opening comprises a filter that will not pass particles greater than one micron in diameter.

5. The system of claim 1, wherein said draw tube is threaded through said refill tube, said tubes introduced into said chamber through a single orifice in said filtered opening.

6. The system of claim 1, wherein said first end of said draw tube is disposed near a bottom of said water container.

7. The system of claim 1, wherein said water container is disposed in a bottom portion of said cabinet.

8. The system of claim 1, wherein said pump is disposed above said water container.

9. The system of claim 1, and further comprising a dispenser mounted on said cabinet, said delivery tube coupled to said dispenser for delivering water thereto.

10. The system of claim 1, and further comprising a remote dispenser for mounting on a refrigerator or the like, said delivery tube coupled to said remote dispenser for delivering water thereto.

11. The system of claim 1, and further comprising a remote dispenser for mounting on a refrigerator or the like, a chilling chamber for disposal in a cooling unit, said delivery tube coupling said pump outlet to an inlet of said chilling chamber, a chilled water tube coupling an outlet of said chilling chamber with said remote dispenser.

12. The system of claim 1, wherein said pump is of the diaphragm, pressure-demand type.

13. A water dispensing system, comprising:

a cabinet;

a water container disposed in said cabinet, said container having at least one impermeable wall and a filtered opening permitting passage of air into said container, but excluding airborne contaminants;

a refill tube, one end being sealably introduced into a refill chamber disposed above said water container, a second end being sealably introduced into the interior of said water container;

a draw tube, being routed through the interior of said refill tube, sealably introduced into the interior of said water container, a second end of said draw tube affixed to an inlet of a demand pump;

a pressurized delivery tube having a first end thereof affixed to an outlet of said pump, and operable to deliver water at an elevated pressure to at least one preselected appliance remote from said cabinet;

said demand pump operable to maintain the pressure of said water in said delivery tube by switching on whenever the sensed pressure drops below a predetermined minimum, said pump switching off when said predetermined pressure has been regained.

14. A drinking water sending and dispensing system, comprising:

a cabinet;

a water container for disposal in a bottom portion of said cabinet, a door of said cabinet for permitting access to said water container;

said water container having water- and gas-impermeable walls, a top wall of said water container having an orifice therethrough, a filtered cap extending across said orifice for permitting the passage of air therethrough but excluding contaminant particles from the interior of said container;

a refill tube extending through a sealed opening in said filtered cap and having a first end within the interior of said water container, a refill chamber mounted in said cabinet above said water container, a second end of said refill tube coupling said refill chamber to said water chamber, said refill chamber having an unsealable and a resealable opening for introducing water therein to fill said water container;

a draw tube for drawing water from said water container, a first end of said draw tube disposed within said interior of said water chamber near the bottom thereof, said draw tube threaded through said refill tube.

a pressure-demand-type water pump disposed above said water container and having an inlet and an outlet, said inlet connected to a second end of said draw tube, said outlet connected to a delivery tube; and a remote dispenser for mounting on a refrigerator or the like for dispensing said water, said delivery tube coupling said remote dispenser to said outlet of said pump.

15. The system of claim 14, and further comprising:

a chilling chamber for disposal inside of a cooling unit, end of said delivery tube coupled to said chilling chamber for delivering water thereto from said water pump, a chilled water tube coupling an outlet of said chilling chamber to said remote dispenser for delivering purified, pressurized, chilled water to said remote dispenser.

16. A method for dispensing water, comprising the steps of:

providing a cabinet for disposing a water container of any of various types therein;

venting the water container through an air filter that permits the passage of air, but excludes contaminates from the interior of the container;

drawing water out of the container through a draw tube by a pressure-demand pump;

delivering pressurized water from an outlet of the pump to at least one dispenser; and refilling said container with purified water through a sealable refiller disposed in said cabinet.

17. The method of claim 16, and further including the steps of:

providing a remote water dispenser for mounting on a refrigerator or the like;

delivering pressurized water through the delivery tube to the remote dispenser.

18. The method of claim 16, and further including the steps of:

providing a remote water dispenser unit for mounting on a refrigerator or the like;

delivering the pressurized water from the pump to a chilling chamber disposed in a cooling apparatus; and delivering pressurized chilled water from the chilling chamber through a dispenser tube to the remote water dispenser.

* * * * *